US007204740B2

(12) United States Patent
Petell

(10) Patent No.: US 7,204,740 B2
(45) Date of Patent: Apr. 17, 2007

(54) INTERNAL BALLOON ILLUMINATION APPARATUS AND METHOD

(75) Inventor: Michael Carl Petell, Long Beach, CA (US)

(73) Assignee: Light Up Balloon Stick, Co., Inc., Long Beach, CA (US)

( * ) Notice: Subject to any disclaimer, the term of this patent is extended or adjusted under 35 U.S.C. 154(b) by 0 days.

(21) Appl. No.: 11/316,582

(22) Filed: Dec. 21, 2005

(65) Prior Publication Data

US 2006/0141898 A1 Jun. 29, 2006

Related U.S. Application Data

(60) Provisional application No. 60/639,127, filed on Dec. 23, 2004.

(51) Int. Cl.
*A63H 3/06* (2006.01)

(52) U.S. Cl. ..... 446/220; 446/219; 362/84; 362/362

(58) Field of Classification Search ..... 446/219–220, 446/221, 223; 362/227, 234, 362–363
See application file for complete search history.

(56) References Cited

U.S. PATENT DOCUMENTS 4,794,498 A * 12/1988 Neumeier ..... 362/186
5,117,344 A * 5/1992 Perez ..... 362/352
5,951,140 A * 9/1999 Feldman ..... 362/84
6,012,826 A * 1/2000 Chabert ..... 362/363
6,302,570 B1 10/2001 Petell et al.
2004/0116039 A1* 6/2004 Mueller et al. ..... 446/220
2004/0174718 A1* 9/2004 Ohlund ..... 362/565
2004/0233674 A1* 11/2004 Vanderschuit ..... 362/352

* cited by examiner

*Primary Examiner*—Robert P. Olszewski
*Assistant Examiner*—Alex F. R. P. Rada, II
(74) *Attorney, Agent, or Firm*—Cislo & Thomas LLP

(57) ABSTRACT

An apparatus for illuminating a balloon from within includes an illumination assembly mounted on a power supply unit. The assembly includes a hollow cylindrical body having a light source (e.g., LED) disposed at one end and electrical inputs protruding from another end. The body of the power supply unit is provided at one end thereof with a shoulder flange and cylindrical spacer to facilitate sealing of the balloon against the assembly. The power supply unit receives power from a power source (e.g., battery), and supplies power to circuitry for controlling the light source. Preferably, the assembly, made of light-weight plastic materials, together with the power source, weighs less than the lift of a helium-filled balloon in which it may be installed.

22 Claims, 11 Drawing Sheets

INTERNAL BALLOON ILLUMINATION APPARATUS AND METHOD

CLAIM OF PRIORITY

The present application claims the benefit of now abandoned U.S. Provisional Patent Application bearing Ser. No. 60/639,127, filed Dec. 23, 2004, the entirety of which is incorporated herein by reference for all purposes.

FIELD OF THE INVENTION

This invention relates generally to an apparatus for and method of illuminating a balloon from within, and more particularly to a structure and method which provides a cycling colored illumination effect while also providing an optimized seal of the balloon upon insertion of the device.

BACKGROUND OF THE INVENTION

Balloons continue to be a very popular novelty item for all ages, particularly balloons filled with helium such that they float in air. Balloons have been embellished in many ways, including illuminating them from within. Typically, devices for such illumination consist of a light source (e.g., a light bulb) connected by wires to a power source (e.g., battery). As the batteries used to power the light source have traditionally been relatively heavy, affecting the ability for a helium-filled balloon to float, batteries are often remotely connected to the light source within the balloon by a length of wire. This wire must travel through an opening in the balloon to reach the light source within, thus exposing the balloon to leakage at said opening. To address this, the prior art has routed wire through a hollow shaft having the light source sealed in an air-tight configuration at one of its ends. A flange, ridge, plug or similar structure is provided on the shaft, spaced apart from the light source, such that the inflated balloon may make an air tight seal therearound, allowing the wires to exit the shaft in an air-tight fashion to be connected to a power source remote from the light source and balloon, while simultaneously simplifying the process of closing the balloon's gas inlet.

While one class of balloon, generally fabricated out of polyester film (e.g., Mylar), can be fabricated to effectively be self-sealing, permitting the shaft to be inserted into an inflated balloon without significantly expelling the gas within, for all other classes of balloons this raises the problem that in the process of inserting the light structure into a filled balloon gas from the balloon will escape. Processes have been developed which involve inserting a special shaft/light combination into a balloon prior to the balloon's inflation, such that the balloon is sealed as previously discussed. The shaft is provided with a one-way valve such that gas introduced at one end can flow out at a point between the shaft's ends, but cannot flow back into the shaft at that point. Gas is then introduced into the end of the shaft protruding from the balloon, entering the balloon at the one-way valve, effectively filling the balloon with the light assembly previously installed. However, such one-way valve arrangements are costly, heavy, and prone to, failure.

Furthermore, prior art devices suffer from the need to remotely connect the light source and the power source if it is desirable that the balloon float in air. This is disadvantageous for numerous reasons, including precluding providing a traditional balloon and ribbon combination, exposing the interconnection wires to possible damage, and additional cost for the interconnection wires and hardware.

In addition, for ornamental and aesthetic reasons, there is a great desire to provide balloons that are colorful and dynamic, in the sense that their colors periodically change. However, prior art devices have heretofore provided only monochromatic illumination. The only way to change colors of the internal lighting is to change the internal light source.

SUMMARY OF THE INVENTION

In order to address the shortcomings of the prior art, one embodiment of the present invention is an illumination assembly for illuminating a balloon from within which includes an integrated power source. The illumination assembly provides a bright light source, a time-modulated polychromatic effect, and is easily inserted into a balloon to facilitate an effective seal.

The illumination assembly includes a hollow elongated cylindrical body. A light source is disposed at one end of the cylindrical body. A circuit and power supply housing is disposed at the opposite end of the cylindrical body. Electrical connections are provided within the cylindrical body to electrically interconnect the light source and electrical components located within the housing. The housing is provided with a shoulder flange and cylindrical spacer to facilitate sealing of the balloon inflation opening against the illumination assembly, and a recess for accepting, for mechanical interconnection, the cylindrical body. The housing is provided with a region for receiving a power source (e.g., battery), circuitry, and an on/off switch, for electrical interconnection with the light source. Furthermore, the illumination device is configured such that the light source may remain approximately at the center of the inflated balloon.

Preferably, the cylindrical body and housing is fabricated from light-weight materials (e.g. plastic) and in a compact configuration such that the complete assembly weighs less than the lift provided by a typical helium-filled balloon into which it may be inserted. Accordingly, the power demands of the light source and circuitry are minimized in order to facilitate use of the smallest, lightest battery possible.

Circuitry designed to be carried by the housing preferably includes an integrated circuit (IC) controller for modulating light emitted by the light source by varying a voltage applied thereto. The light source may be of a type responsive to this varying voltage such that different voltages cause the light source to illuminate at different wavelengths and for different lengths of time. For example, the light source may be a light emitting diode (LED) of a type which, in response to a first voltage, emits light of a first color, and in response to a second voltage emits light of a second color. Additional circuitry may be provided which automatically cycles the voltage provided to the light source so that the light source emits a periodically modulated polychromatic effect.

According to one further aspect of the present invention, the illumination assembly may be disposed within a retaining sleeve, the retaining sleeve serving to fixably attach a balloon to the illumination assembly at a first axial end thereof, and to fixably attach a mechanism, such as a cylindrical or rectangular rod, permitting a user to hold the balloon and illumination assembly combination or secure same to a structure at a second axial end thereof. The retaining sleeve includes a conical collar for supporting the balloon near the point of attachment. Finally, the retaining sleeve is open on one lateral face to permit actuation of the on/off switch.

BRIEF DESCRIPTION OF THE DRAWINGS

These and other objects, features, and advantages of the present invention will become apparent from the following detailed description and the appended drawings in which like reference numerals denote like elements between the various drawings, but which are not to scale.

DETAILED DESCRIPTION OF THE INVENTION

Figure 1:
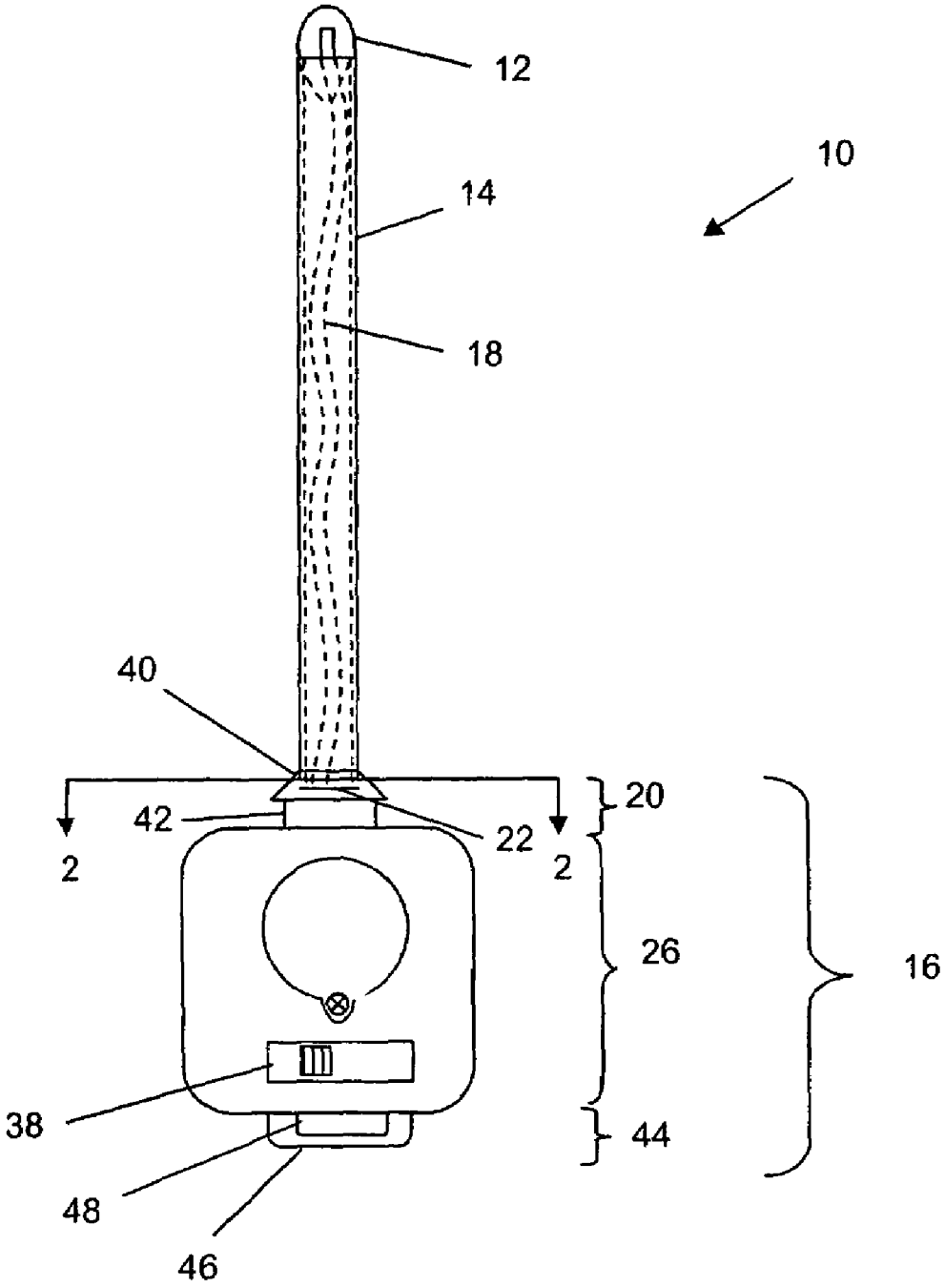
FIG. 1 depicts an illumination apparatus and its components according to an embodiment of the present invention.

FIG. 1 depicts an illumination assembly 10 and its components according to one embodiment of the invention. Illumination assembly 10 comprises a light source 12, a hollow elongated cylindrical body 14, and a circuit and power supply housing 16. Electrical interconnections (e.g., wires) 18 are disposed within the central hollow of cylindrical body 14 such that they permit electrical communication between light source 12 and circuitry and a power source (not shown) disposed within housing 16.

According to one embodiment, light source 12 is a light emitting diode (LED), preferably of a high-brightness type, and capable of polychromatic emission at low voltage. Such high-brightness polychromatic LEDs are commercially available from various vendors, such as LumiLEDs, Inc. of San Jose, Calif. According to another embodiment, the light source may be a SMT (Surface Mount Technology) LED. Various other types of semiconductor light sources may be used as well. Semiconductor light sources are preferred since their voltage requirements are relatively low, their size and weight permit production of a small, lightweight assembly, and piece cost is relatively low.

Hollow elongated cylindrical body 14 is preferably formed of a lightweight, thin-walled plastic, polyvinylchloride (PVC), styrene, Lexan® (polycarbonate resin) or similar tubing between 2 and 5 mm in outside diameter and 15 to 25 cm in length (although other sizes are contemplated by the present invention, depending upon the application thereof). A material with a low surface friction coefficient is preferred, as such a material will enhance the ease with which the device may be assembled and ultimately deployed within a balloon. The interior of body 14 should be of sufficient diameter that two lightweight, thin-gauge wires representing interconnections 18, may be threaded therein. Cylindrical body 14 should be somewhat flexible, yet the wall thickness and material of cylindrical body 14 should be such that it is laterally, axially, and torsionally sufficiently rigid as to not significantly inelastically deflect or collapse under the weight of light source 12 and various forms of mechanical shock it may experience in use.

Two wires, representing electrical interconnections 18, are electrically communicatively coupled to light source 12, and extend within the interior of hollow elongated cylindrical body 14. Light source 12 is then mechanically secured to a first end of hollow elongated cylindrical body 14, typically by means of an adhesive, silicone gel, or the like. With interconnections 18 disposed therein, the hollow core of cylindrical body 14 is filled with a material so as to prevent leakage of the inflation gas of a balloon into which the assembly is ultimately inserted. For this reason, silicone gel is a preferred adhesive to secure light source 12 to cylindrical body 14, as it serves the roll of both adhesive and filler.

According to one embodiment of the present invention, light source 12 is disposed coaxially exterior to the hollow central region of cylindrical body 14, with a generally dome-shaped casing forming a cap of the cylindrical body 14. According to another embodiment of the present invention, light source 12 is disposed proximate the end but within the interior of hollow elongated cylindrical body 14. In these embodiments, the casing of light source 12, or the end face of the cylindrical body 14, respectively, is rounded so as to facilitate insertion into, and avoid puncturing once inserted in, the balloon.

Circuit and power supply housing 16 typically comprises several regions, each performing a different role in the completed assembly. Although conceptually separated, these regions are preferably integrally formed as a single structure. The dimensions, configurations, and materials are selected such that housing 16 may be formed by casting or molding a lightweight plastic material. These considerations permit rapid and low defect-rate manufacture of a low cost, lightweight housing, ultimately minimizing the cost and weight of the final illumination assembly 10. Furthermore, the relatively small size and configuration of the illumination assembly (e.g., housing 16 being of primarily rectangular plan) permits for efficient packing for shipment and sale, enabling a reduced cost of packaging and shipping. In product markets with minimal margins, such considerations prove very cost effective.

Figure 2:
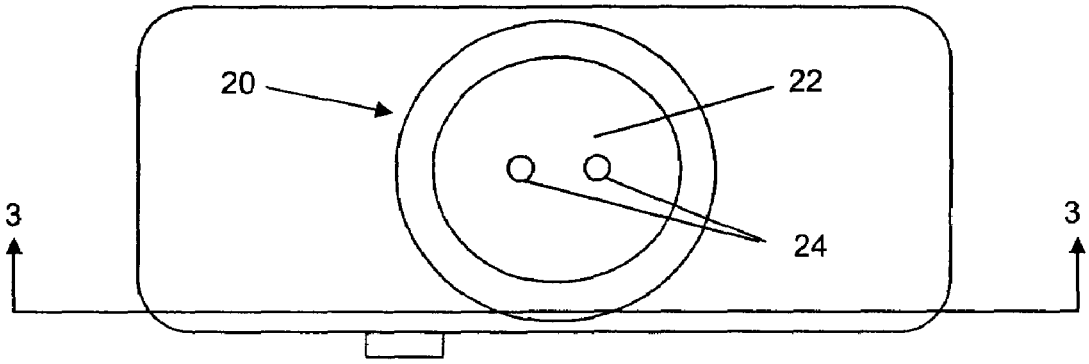
FIG. 2 depicts a partial top view of a housing of the illumination apparatus of FIG. 1, according to an embodiment of the present invention.

A first region, connector region 20, shown in FIG. 2, is configured to receive the end of cylindrical body 14 opposite the location of light source 12. Region 20 includes a generally circular recessed region 22, having diameter approximately equal to the outside diameter of cylindrical body 14. At the base of recessed region 22 are located electrical connections 24 enabling electrical connection between interconnections 18 and a power source (not shown) disposed within housing 16. Each of the two wires forming interconnections 18 are connected, respectively, to one of the electrical connections 24. Thereafter, cylindrical body 14, having light source 12 affixed thereto and electrical interconnections 18 provided therein, is mechanically secured in recessed region 22. Optionally, cylindrical body 14 may be adherently affixed in region 22 by way of an adhesive or the aforementioned silicone gel. The completed assembly 10 is illustrated in FIG. 1. It will be appreciated that assembly 10 has been described in terms of an ordered set of steps. However, variations on the order of these steps is within the scope and spirit of the present disclosure, and the description above and herein shall not serve to limit the breadth of the claimed invention claimed.

Figure 4:
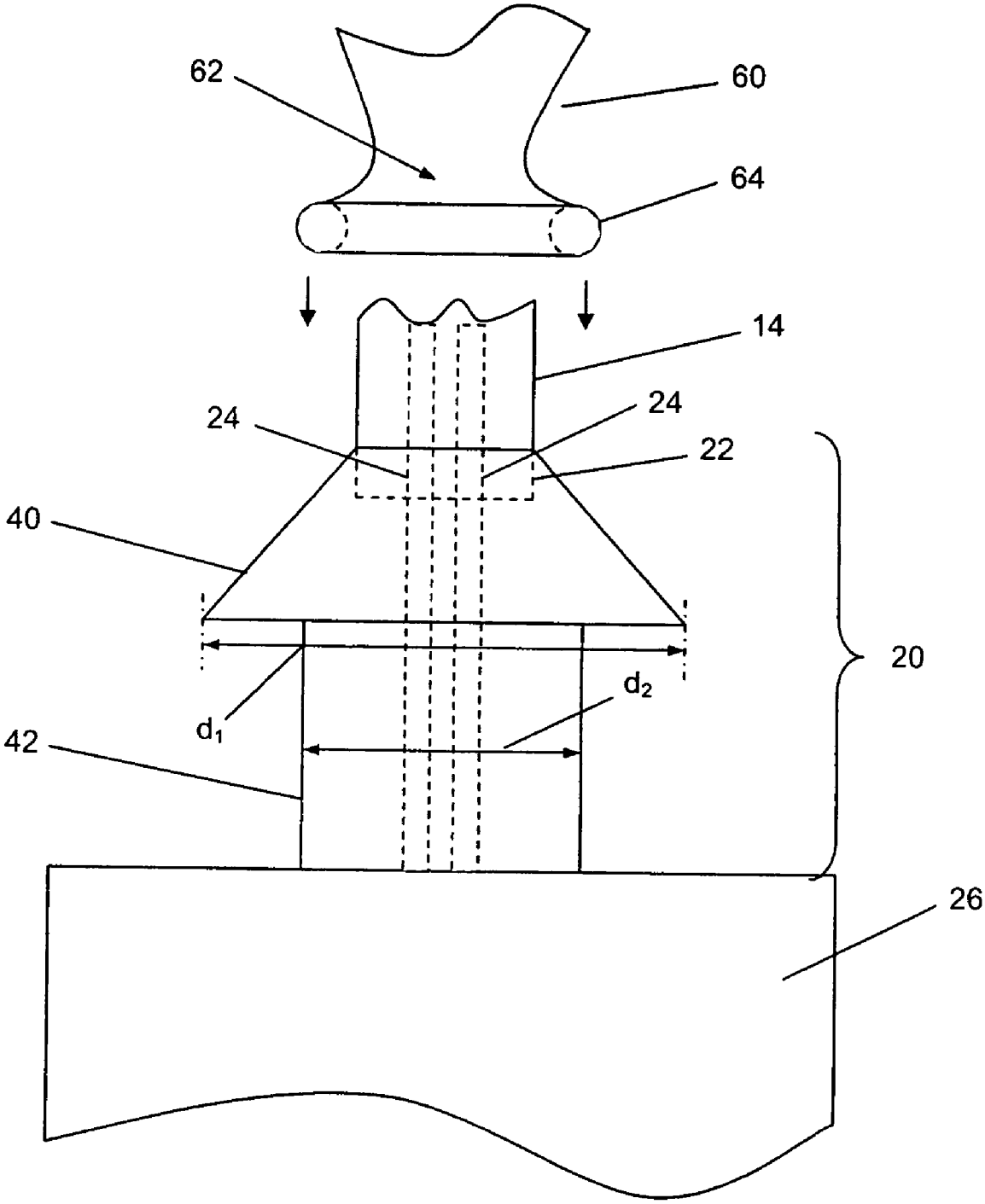
FIG. 4 depicts a close-up view of the attachment region of the illumination apparatus of FIG. 1 according to an embodiment of the present invention.
Figure 8:
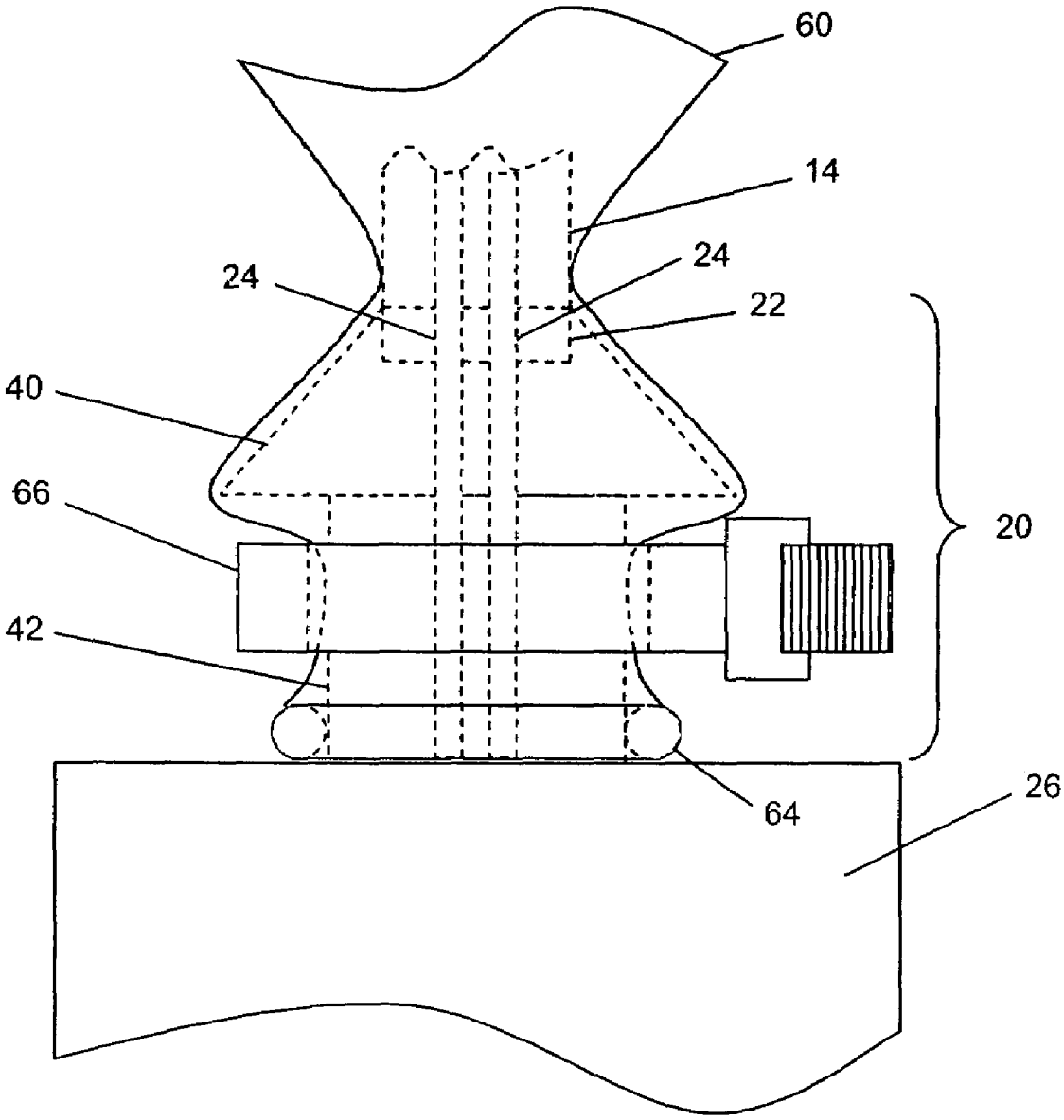
FIG. 8 is a detailed view of the interface of a balloon and the illumination apparatus of FIG. 7 according to an embodiment of the present invention.

With reference now to FIG. 4, connector region 20 is provided with a shoulder flange 40 and cylindrical spacer 42 to facilitate mechanical attachment of a balloon 60 to the illumination apparatus 10, as well as to facilitate sealing of the balloon inflation opening 62 against the illumination assembly, as further described below. Shoulder flange 40 is preferably angled or rounded in such a configuration as to facilitate slipping a typically balloon inflation opening collar 64 thereover. Shoulder flange 40 flares or is angled outward to have a region whose diameter $d_1$ is greater than the external diameter $d_2$ of cylindrical spacer 42. Cylindrical spacer 42 is preferably of a height sufficient to accommodate a cinching device 66 (shown in FIG. 8), such as a small ratcheting belt (often referred to as a zip-tie) rubber band, twist tie, etc., in order to close off and secure the balloon inflation opening above collar 64 by compressing same against cylindrical spacer 42.

Figure 3:
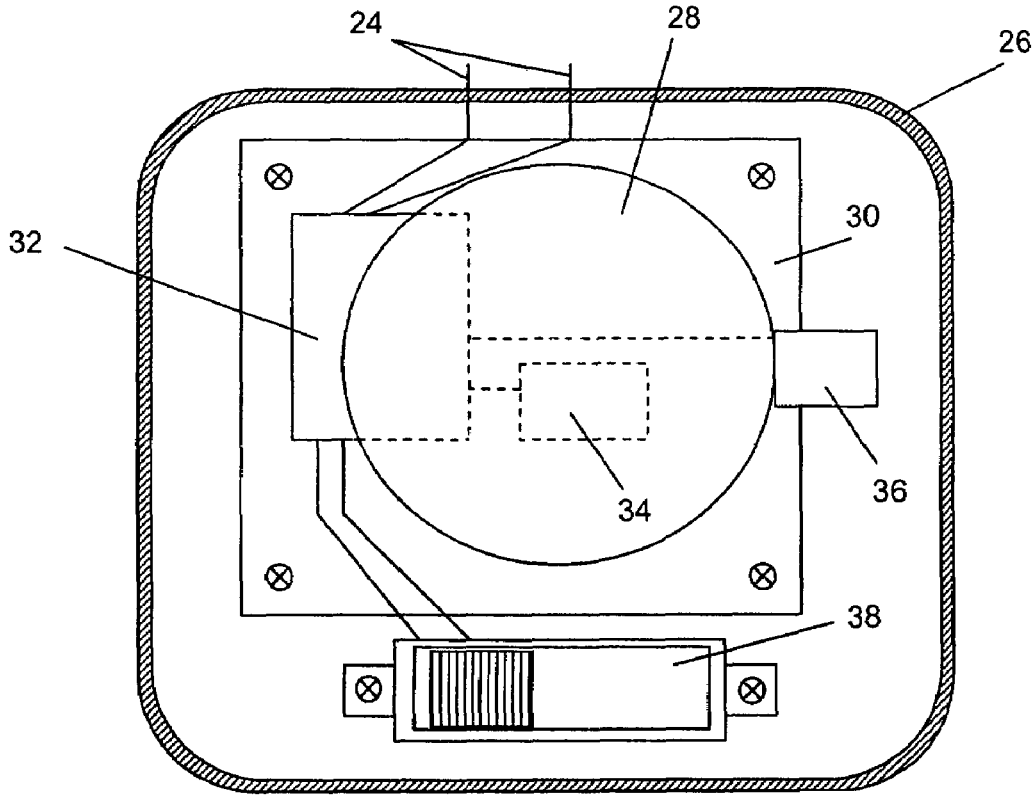
FIG. 3 depicts a partial cut-away view of a housing and elements disposed therein of the illumination apparatus of FIG. 1, according to an embodiment of the present invention.

Circuitry and power supply region 26 of housing 16 is shown in FIG. 3. Region 26 is configured to receive a power source and circuitry supporting operation of the light source 12. Provided therein is power supply 28, typically one or more light-weight, long-life, low-voltage batteries. Also provided within region 26 is a circuit board 30 for receiving an integrated circuit 32, battery connections 34 and 36, and various electrical interconnections. Further provided within region 26 is switch 38, such as a manual on/off switch for enabling and disabling light source 12.

As is further discussed below, the lift provided by the filling gas within a balloon in which assembly 10 may be disposed may exceed the weight of illumination assembly 10, resulting is the balloon tending to float upwards (however, it will be appreciated that the present invention may be disposed within a balloon containing virtually any filling medium, such as helium, air, other inert gas, etc.) Thus, it may be necessary to provide an attachment device, such as a ribbon, string, or the like to secure the balloon, or it may be necessary to secure a ballast to the balloon to keep in it place. An attachment region 44 of housing 16 is configured to permit securing such an attachment device (ribbon, string, ballast or other means) or decoration to the balloon. Region 44 consists of a solid arched or hooked structural member 46 attached or integrally formed at one or both ends thereof to the exterior of region 16 to thereby define an opening 48. Ribbon, string or similar decorative or attaching means may be introduced through opening 48 and around arched member 46 and secured, for example by tying.

Securing a ribbon or string through opening 48 and around arched member 46 additionally provides a degree of safety in the event the balloon should burst, in that the combination of the balloon and illumination assembly is prevented from becoming a projectile. Although, even unsecured by ribbon or string, should the balloon burst, the weight of the illumination assembly 10, alone, provides a degree of safety in that it will cause the balloon and assembly combination to fall vertically downward as opposed to flying here and there in an airborne frenzy.

Figure 5:
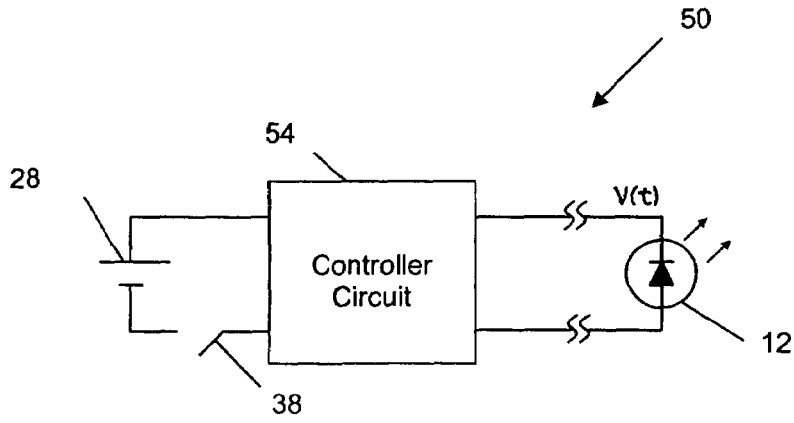
FIG. 5 depicts a controller circuit according to an embodiment of the present invention.
Figure 6A:
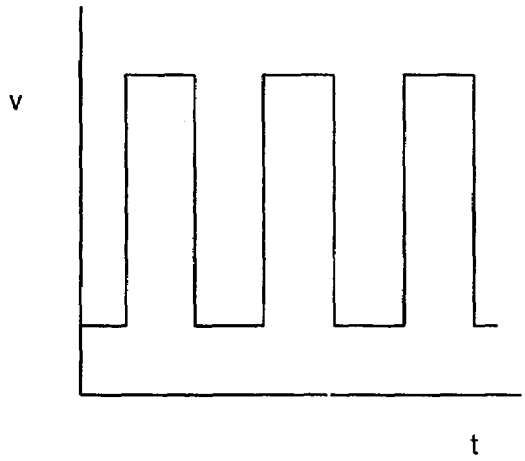
FIGS. 6A and 6B depict output waveforms of the controller circuit of FIG. 4 according to an embodiment of the present invention.
Figure 6B:
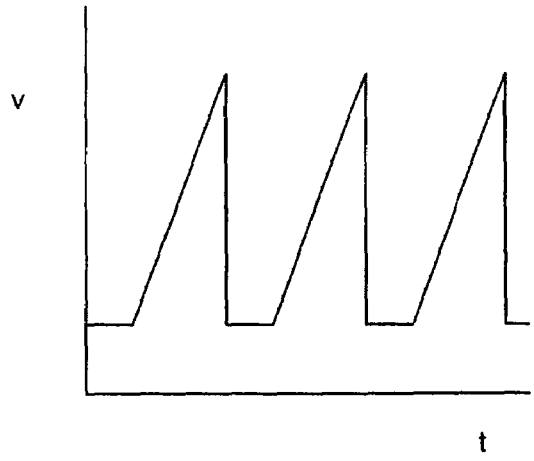

As previously discussed, disposed within circuitry and power supply region 26 will typically be one or more low-voltage batteries. For example, in order to conserve space and weight, stacked or side-by-side 3-volt batteries such as CR 2032 may be employed (the actual voltage and current requirements will be determined in accordance with the circuitry described below and light source 12). Longevity of the power supply is of concern, so long-life batteries such as lithium batteries may be employed. Such batteries often have lifespans over 25 hours. However, in the event of its failure, power supply 28 is designed to be user replaceable. Also disposed within circuitry and power supply region 26 will be circuit board 30 for receiving an integrated circuit 32, battery connections 34 and 36, and various electrical interconnections. Referring now to FIG. 5, there is shown a diagram of a circuit 50 of the illumination device according to an embodiment of the invention. Power source 28 is coupled to an integrated controller circuit 54. In one embodiment, controller circuit 54 includes nonvolatile memory that contains a program for controlling the output waveforms of the controller circuit. As illustrated, the output waveforms are time-modulated. The output waveforms in turn control the illumination timing, color, and/or brightness of light source 12. The circuit may be enabled or disabled by switch 58. Exemplary output waveforms are shown in FIG. 6A and FIG. 6B. Each such waveform is capable of producing a different chromatic modulation of light source 56, as further described below. Note that controller circuit 54 may be programmed or programmable to produce any of a wide variety of output waveforms to achieve different visual effects.

Figure 7:
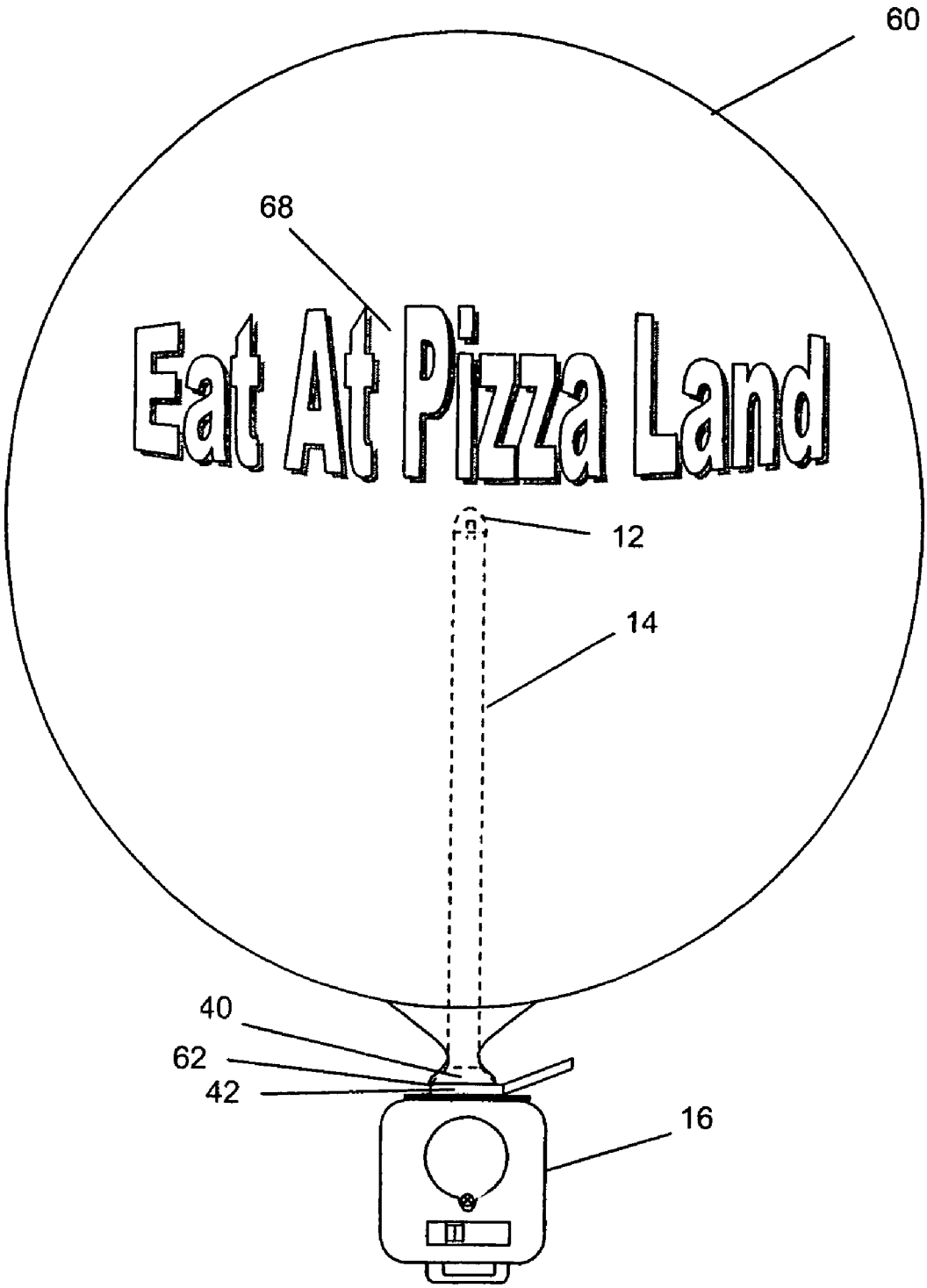
FIG. 7 depicts an illumination apparatus and its components as might typically be disposed in an inflated balloon according to an embodiment of the present invention.

With reference now to FIG. 7, there is shown therein an illumination assembly 10 disposed within an inflated balloon 60. Several principles are illustrated. First, note that a small cinching device 66, shown in the form of a ratcheting belt, is used to secure the inflation opening of balloon 60 against cylindrical spacer 42, below shoulder flange 40. While means other than a ratcheting belt may be employed to seal the inflation opening of balloon 60, the light weight, secure closure, and rapid and simple application of such means leads to this being preferred over others. This arrangement is also shown in more detail in FIG. 8.

Second, note that as shown in FIG. 7 light source 12 is positioned near the center of the inside of balloon 60. This is preferable in order to uniformly illuminate the balloon from within, and minimize visual focus upon light source 12 itself so that it appears to a viewer that the entirety of the interior of balloon 60 is illuminated. This effect is obtained in part by the internal reflection of light provided by light source 12 off the interior wall of the balloon 60. In order to accomplish this, the cylindrical body 14 is available in different lengths, depending upon the dimensions of the balloon in which it will be deployed.

Third, although of a light-weight design and construction, illumination assembly presents sufficient mass to maintain the orientation of balloon 60 such that its inflation opening is positioned at the bottom of the balloon. This is accomplished by concentrating the components of assembly 10 in the circuit and power supply housing 16. This arrangement is particularly beneficial when used with balloons having oriented indicia 68 such as lettering or images printed thereon.

Fourth, the structural shape of housing 16 and arrangement of components therein is such that the centroid lies on the longitudinal axis of the assembly 10. This means that gravity tends to cause a generally vertical alignment of the longitudinal axis along the cylindrical body 14. In addition to further facilitating a desirable alignment of the balloon 60, this arrangement ensures that light source 12 is positioned nearest the circumferential center (in this case, equally distant side-to-side) of the inflated balloon, as opposed to listing to one side or another. As previously mentioned, this enhances the illumination effect produced by light source 12.

Finally, while the mass of illumination assembly 10 is important from the perspective of maintaining alignment of the balloon 60 and the light source 12 disposed therein, it is desirable to minimize that mass, for example so that the buoyancy provided by the filling gas within balloon 60 (e.g., helium) overcomes the weight of the combination of balloon and illumination assembly, thereby permitting the balloon to float or rise upward against the pull of gravity. Therefore, according to one embodiment, the illumination assembly 10, including power supply 28, weighs less than ten grams. This has been determined to be just below the lift of a typical 12-inch helium-filled latex balloon. In one embodiment, power supply 28, comprising a small lithium battery, does not exceed four grams, and the remainder of the illumination assembly 10 does not exceed twelve grams.

The process of providing an inflated balloon 60 with illumination assembly 10 inserted therein is explained with reference to FIGS. 9A through 9D. The process begins at FIG. 9A with the inflation of balloon 60 with air, helium, etc., by methods well known. The operator 76 then applies a cinching device 66, secured but not fully tightened, around the inflation opening 62 of balloon 60. The cinching device 66 should be left sufficiently loose that the cylindrical body 14 can be inserted into the balloon opening. Optionally, the cinching device 66 may be applied prior to inflation of the balloon, again sufficiently loose to permit the entry of a filling nozzle (not shown) for introducing the inflation gas into the interior of the balloon 60, as well as to permit the introduction of cylindrical body 14.

Figure 9A:
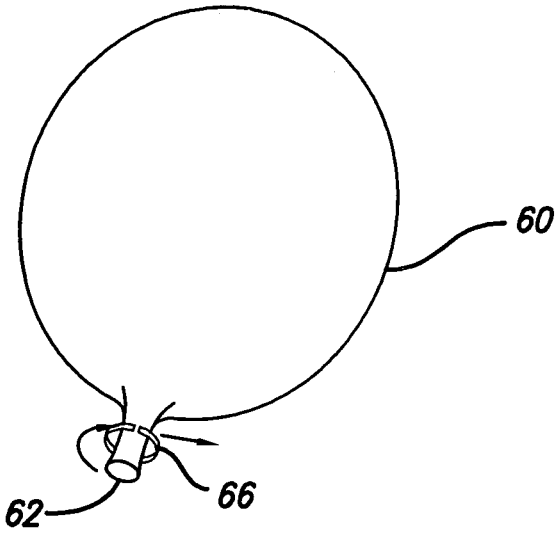
FIGS. 9A through 9D depict a method of sealably inserting an illumination apparatus into an inflated balloon according to an embodiment of the present invention.
Figure 9B:
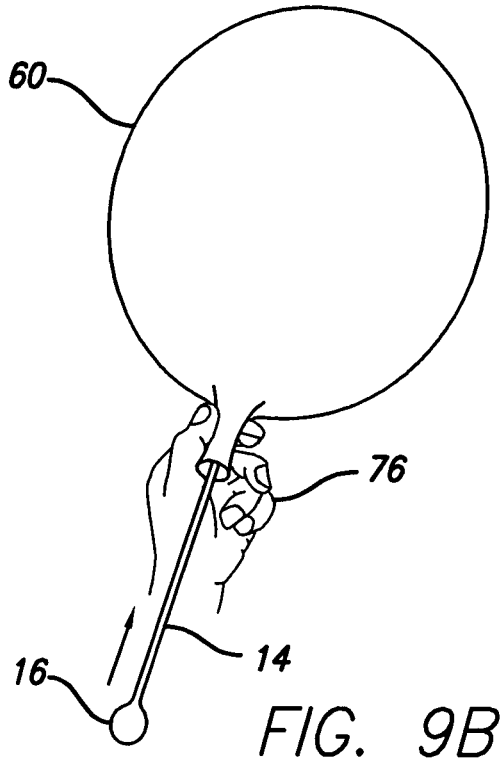
Figure 9C:
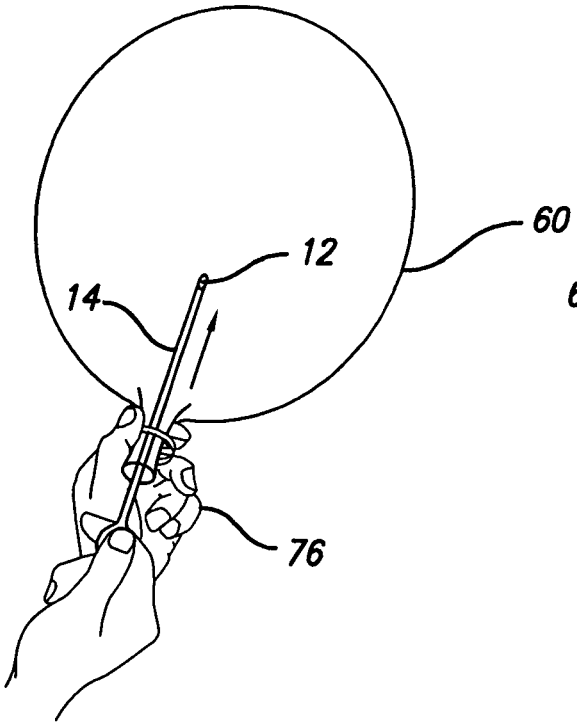
Figure 9D:
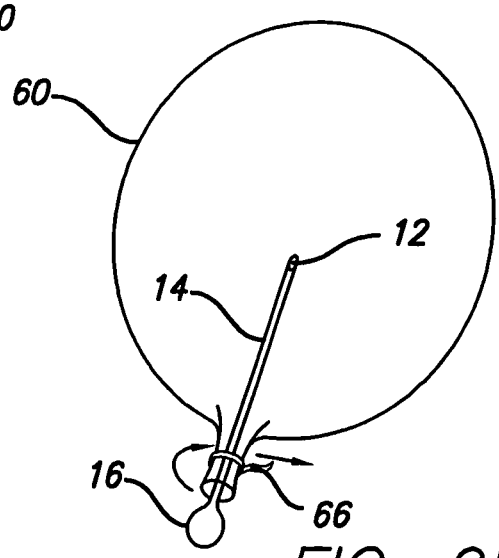

As shown in FIG. 9B, operator 76 then pinches the inflation opening of balloon 60 to prevent the escape of the inflation gas. With reference next to FIG. 9C, operator 76 then loosens her grip on the inflation opening 62 of the balloon sufficiently to allow slipping the light source 12 and cylindrical body 14 therein. Finally, as illustrated in FIG. 9D, the balloon material at inflation opening 62 is positioned over the shoulder flange 40 and cylindrical spacer 42 (again, shown in detail in FIG. 8), and the cinching device 70 is tightened to securely attach the illumination assembly 10 to balloon 60 and to seal inflation opening 62 so that the inflation gas is retained within the balloon. While some of the inflation gas may escape in the aforementioned process, with practice the operator is able to quickly and efficiently perform these steps with a minimal loss of gas and balloon inflation pressure. Furthermore, the aforementioned process is quick, simple, and secure, necessities for operators working in theme parks and the like.

The illumination assembly according to the present invention is an improvement over the prior art in a wide variety of applications. For example, according to one embodiment of the invention, a balloon having a light source disposed therein may be used for advertising purposes. For example, a latex (or other material) balloon 60 may have indicia 68, such as a logo, slogan, image, etc. formed thereon. When balloon 60 is illuminated from within by light source 12, the indicia is accentuated for viewing as against the background of the balloon. The changing color of the illumination draws particular attention to the indicia, highlight the effect of the message, advertising, etc. The illumination assembly according to the present invention may be manufactured and sold at low costs, thus in some applications enabling the assembly to be given away to potential customers free of charge without great expense to the advertiser.

Furthermore, the light source according to the present invention may be disposed within a wide variety of shapes of balloons, such as those having the shape of cartoon characters, objects, and the like, as well as shaped balloons disposed within semitransparent traditional balloons, also known as "hourglass" balloons. Such shaped and hourglass balloons are popular at amusement parks and similar attractions.

Figure 10:
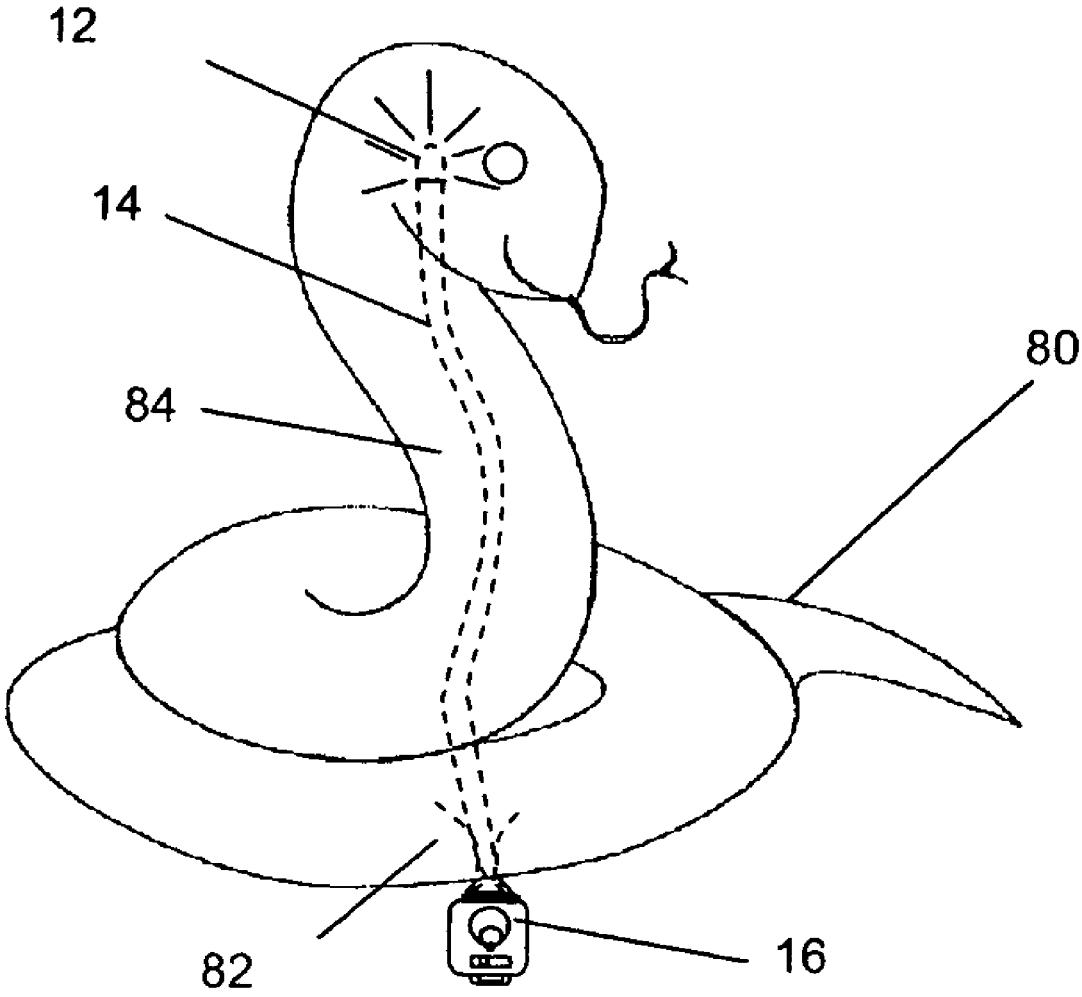
FIG. 10 depicts an alternative embodiment of an illumination apparatus and its components as might be disposed in an inflated balloon according to the present invention.

The design of the light source proves particularly useful for insertion into such shaped and hourglass balloons. For example, with reference to FIG. 10, the cylindrical body 14 can be formed of a material that can be inelastically curved or arched, if needed to be inserted into a shaped balloon 80 having a curved inflation region 82 or internal region 84. In these cases, the light source 12 may thus still be positioned equally distant from sidewalls of the balloon to provide even illumination, as well as possibly providing the internal reflection effect discussed below.

Figure 11:
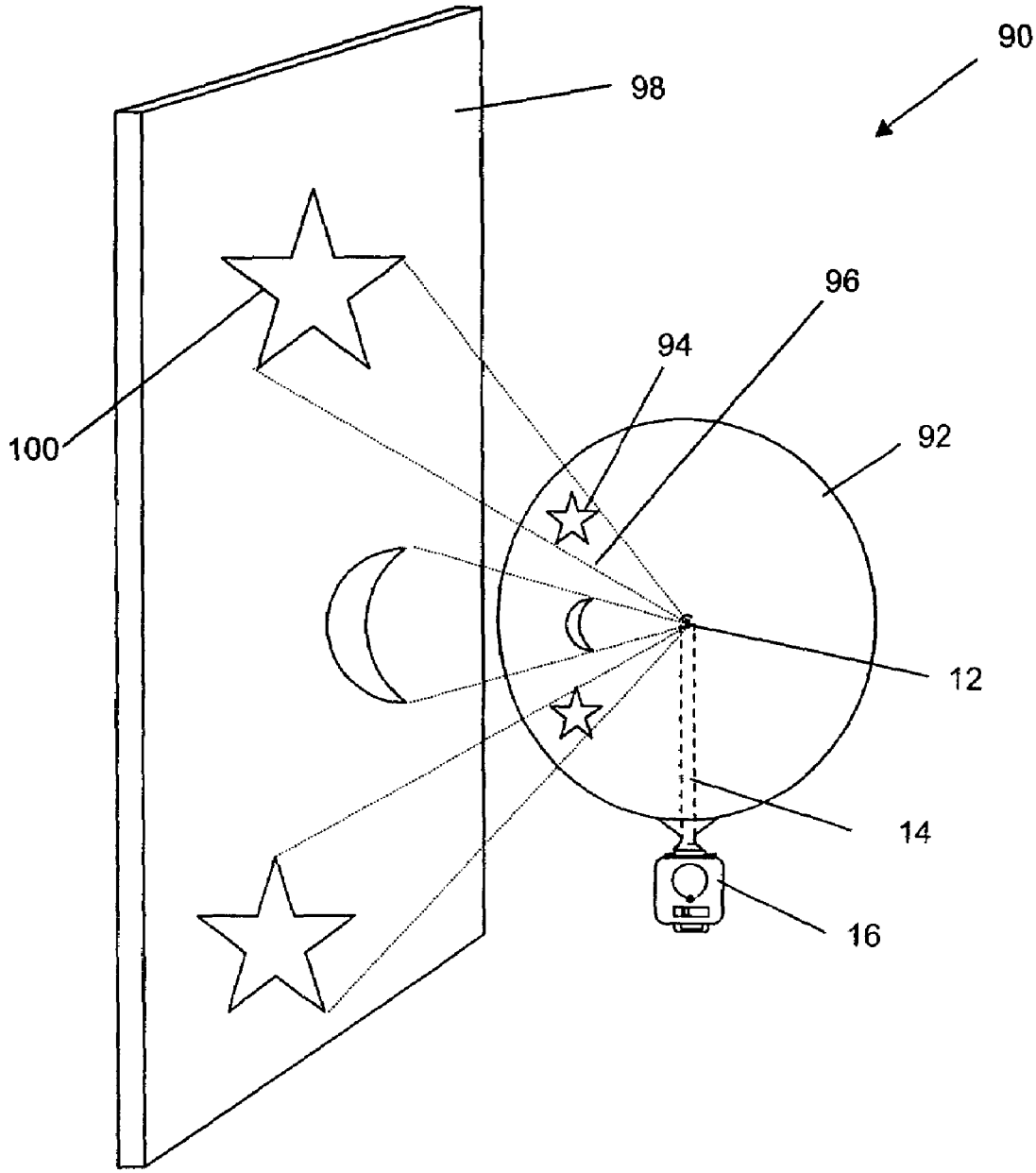
FIG. 11 depicts the projection of indicia from the surface of a balloon onto another surface according to an embodiment of the present invention.

Further still, the light source of the present invention disposed within a balloon can be used as a projector to project images formed on the surface of the balloon onto walls or other surfaces. FIG. 11 shows an exemplary embodiment 90. A balloon 92 may be provided with indicia 94 imprinted thereon, such that indicia 94 form the more transparent region of the surface of balloon 92, and the region 96 between indicia 94 the more opaque region of the surface of balloon 92. With the light source 12 of the present invention disposed within such a balloon 92 (by attaching illumination assembly 10 to the inflated balloon as previously discussed), and the balloon located in a darkened room, the indicia 94 may be projected onto the walls 98 of the room, creating images 100 thereon. As the light source 12 changes color the projected images 100 change color, providing a very dramatic effect for a user. This same effect may be employed with virtually any image printed on the surface of the balloon, from shapes to cartoon or movie characters, and from names to advertising.

Finally, it will be noted that the light emitting from a light source disposed within a balloon must cross a boundary, namely the walls of the balloon, before reaching the viewers eyes. Light from the light source will be emitted in a wide range of directions, such that light rays will strike the walls of the balloon at a variety of angles. Based on the well-understood principles of boundary behavior of light, some of the incident light will be transmitted after refraction through the walls of the balloon to its exterior, and some will be reflected back into the interior of the balloon. Since the light waves refract away from the normal, the angle of refraction is greater than the angle of incidence. For large angles of incidence, the light is not refracted at all, but rather reflected, an effect known as internal reflection. By this effect, the quantity and color of the light ultimately passing through the walls of the balloon differ from that emitted by the light source, as the internally reflected light combines with other reflected light and with newly emitted light from the light source. For example, internally, colors blend with one another, producing colors not originally emitted by the light source. For example, while the light source might be capable of producing only three colors, say red, green, and blue, the effect of internal reflection produces additional colors such as pink, purple, turquoise, etc. which may be viewed from outside of the balloon. This effect is particularly pronounced in certain colors of balloons, such as white.

Figure 12:
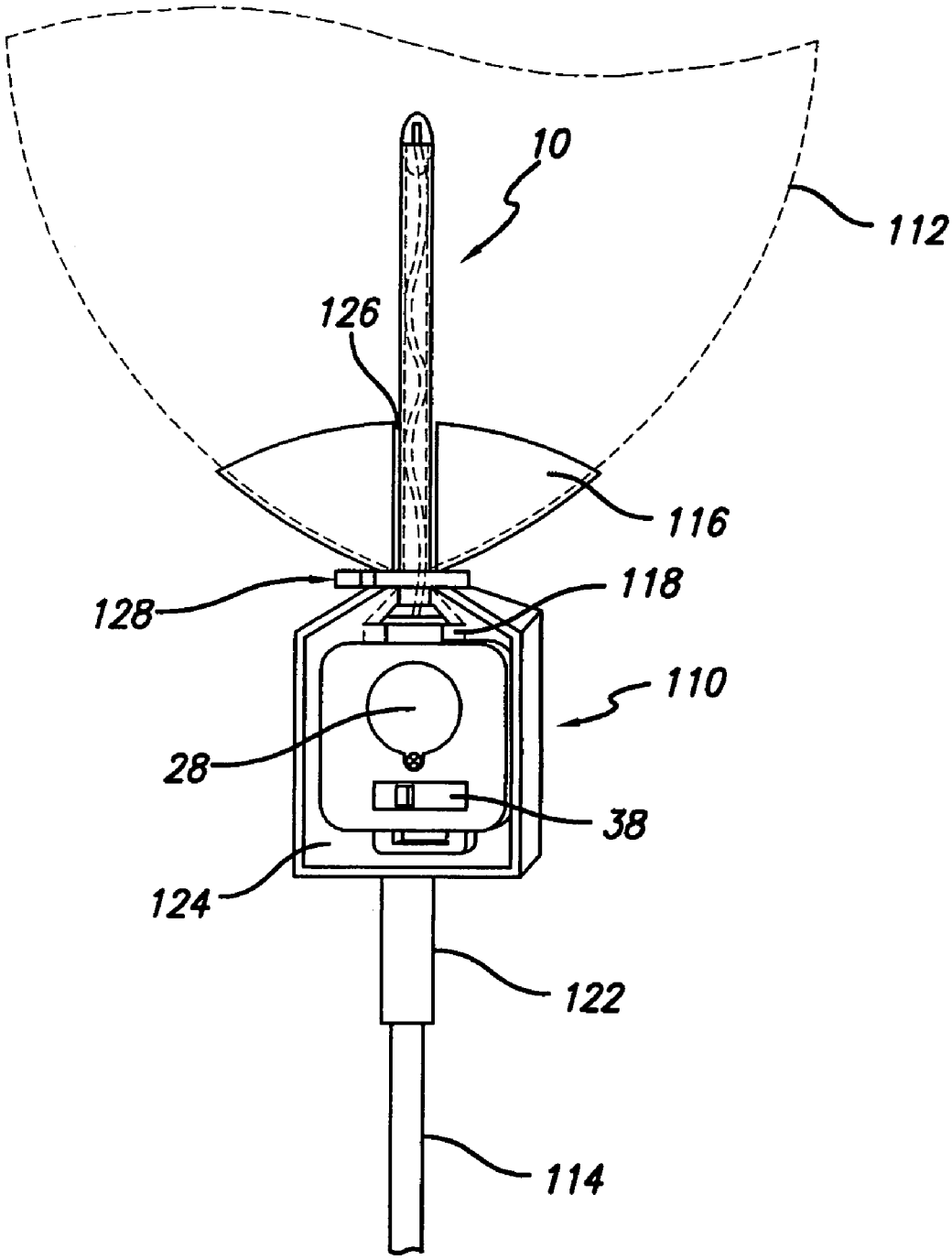
FIG. 12 is an illustration of an illumination apparatus disposed within an optional retaining sleeve according to another embodiment of the present invention.

FIG. 12 illustrates a final aspect of the present invention explicitly described herein. As shown therein, the illumination assembly 10 may be disposed within a retaining sleeve 110, retaining sleeve 110 serving to fixably attach a balloon 112 to illumination assembly 10 at a first axial end thereof, and to fixably attach a holding mechanism 114, such as a cylindrical or rectangular rod, permitting a user to hold the balloon and illumination assembly combination or secure same to a structure at a second axial end thereof. Retaining sleeve 110 includes a conical collar 116 for supporting the balloon near the point of attachment. Conical collar 116 is sized such that it provides a secure fit nearest shoulder flange 40, such that an inflation opening 118 of balloon 112 is securely retained thereover in an airtight fashion. Furthermore, conical collar 116 is shaped such that is provides support in region 120 for the lower portion of balloon 112, nearest inflation opening 118.

Retaining sleeve 110 further includes a tubular region 122, whose cross-section is sized and shaped to securely accept an auxiliary holding mechanism 114. The combination of tubular region 122 with mechanism 114 secured therein permits a user to hold a balloon and illumination assembly combination, or secure same to a structure or the like.

Retaining sleeve 110 is provided with an open lateral face 124 and a slot 126 in conical collar 116, to permit disposition of the illumination assembly 110 therein. Once disposed therein, the balloon and light assembly combination may be retained in place within the interior of retaining sleeve 110 by a cinching device 126 or similar retaining mechanism. Access to on/off switch 38 and to power supply 28 are facilitated by disposing same to face outward when illumination assembly 10 is disposed within retaining sleeve 110.

Figure 13:
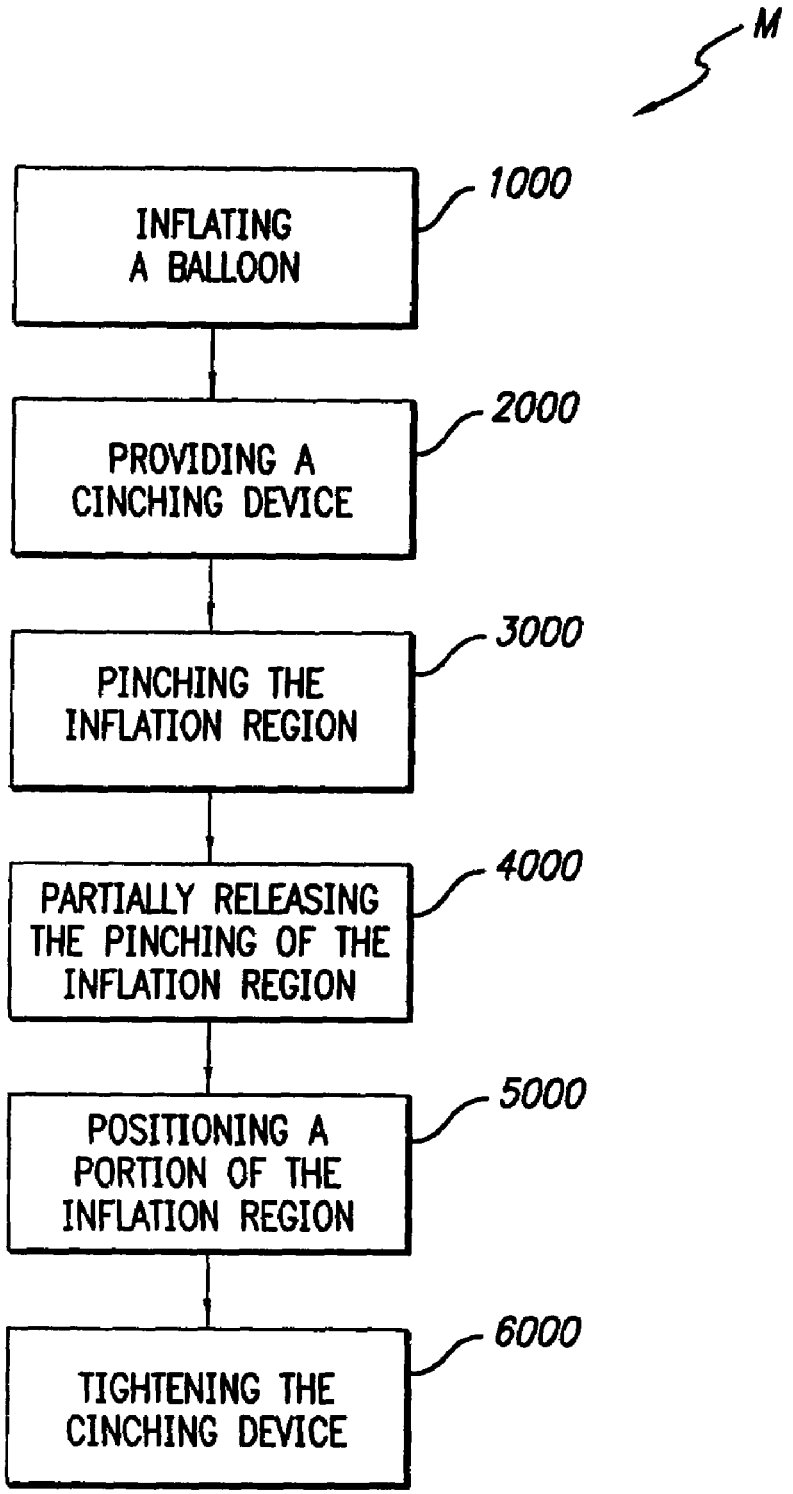
FIG. 13 is a flowchart of a method of providing an illuminated inflated balloon, in accordance with the present invention.

FIG. 13 illustrates, in a flowchart, a method M of providing an illuminated inflated balloon, in accordance with the present invention. The method M of providing an illuminated inflated balloon is achieved by introducing therein selected parts of an illumination assembly which includes a housing 16, a cylindrical spacer 42 attached thereto, a shoulder flange 40 attached to the cylindrical spacer 42, an elongated cylindrical body 14 attached to the shoulder flange 40, and a light source 12 attached to the elongated cylindrical body 14, the method M comprising the steps of: inflating a balloon 60 with an inflation gas, as indicated by block 1000; providing around an inflation region 82 of the balloon 60 a cinching device 66 such that the cinching device 66 partially but not completely closes off the inflation region 82, as indicated by block 2000; pinching the inflation region 82 such that inflation gas does not escape from the balloon 60, as indicated by block 3000; partially releasing the pinching of the inflation region 82 and inserting through the inflation region 82 the light source 12 and the elongated cylindrical body 14 of the illumination assembly such that the light source 12 is disposed in the interior of the balloon 60, as indicated by block 4000; positioning a portion of the inflation region 82 of the balloon 60 and the cinching device 66 over the shoulder flange 40 and the cylindrical spacer 42 of the illumination assembly, as indicated by block 5000; and tightening the cinching device 66 such that the portion of the balloon inflation region 82 overlaying the cylindrical spacer 42 of the illumination assembly is made to be in airtight physical contact with the cylindrical spacer 42, as indicated by block 6000, thereby securing the balloon 60 to the illumination assembly and creating a seal which prevents leakage of the inflation gas at the cylindrical spacer 42.

While a plurality of preferred exemplary embodiments have been presented in the foregoing detailed description, it should be understood that a vast number of variations exist, and these preferred exemplary embodiments are merely representative examples, and are not intended to limit the scope, applicability or configuration of the invention in any way. Rather, the foregoing detailed description provides those of ordinary skill in the art with a convenient guide for implementation of the invention, and contemplates that various changes in the functions and arrangements of the described embodiments may be made without departing from the spirit and scope of the invention defined by the claims thereto. The scope of the invention is therefore intended to be limited solely by the scope of the appended claim.

What is claimed is:

1. An apparatus for illuminating an inflatable structure from within, comprising:

a housing having formed therein a region for accepting a power supply and a region for accepting a control circuit;

a control circuit disposed in said region for accepting a control circuit, said control circuit including circuitry for providing a time-modulated voltage to a light source electrically connected thereto;

a cylindrical spacer having an external diameter, secured at a first axial end thereof to said housing, configured to receive a portion of an inflatable structure and provide a surface against which that portion of the inflatable structure may be secured;

a shoulder flange having a region whose diameter is greater than the external diameter of said cylindrical spacer, secured to said cylindrical housing at a second axial end opposite said first axial end, configured to permit the placement of a portion of an inflatable structure thereover, but to resist removal of that portion of the inflatable structure;

an elongated cylindrical body secured at a first axial end thereof to said shoulder flange and extending axially away from said housing;

a polychromatic light source secured at a second axial end of said elongated cylindrical body opposite said first axial end; and electrical interconnections connecting said polychromatic light source and said control circuit.

2. The apparatus of claim 1, wherein said light source is a light emitting diode.

3. The apparatus of claim 1, wherein said light source is a surface mount technology light emitting diode.

4. The apparatus of claim 1, further comprising a generally dome-shaped casing forming a cap at the second axial end of the elongated cylindrical body within which said light source is disposed.

5. The apparatus of claim 1, wherein said light source is disposed proximate the second axial end of said elongated cylindrical body but within the interior of said elongated cylindrical body.

6. The apparatus of claim 1, wherein said elongated cylindrical body is configured to be inelastically deformed without breaking.

7. The apparatus of claim 1, further comprising an attachment device receiving region secured to said housing, configured to allow the connection of an external attachment device thereto.

8. An illuminable balloon assembly of the type for receiving a balloon having a central region and an inflation region, comprising:

a housing having formed therein a region for accepting a power supply and a region for accepting a control circuit; a control circuit disposed in said region for accepting a control circuit, said control circuit including circuitry for providing a time-modulated voltage to a light source electrically connected thereto;

a cylindrical spacer having an external diameter, secured at a first axial end thereof to said housing, receiving a portion of the inflation region thereover and providing a surface against which that portion of the inflation region is secured;

a shoulder flange having a region whose diameter is greater than the external diameter of said cylindrical spacer, secured to said cylindrical housing at a second axial end opposite said first axial end, over which a portion of the inflation region extends, which resists removal of that portion of the inflation region;

an elongated cylindrical body secured at a first axial end thereof to said shoulder flange and extending axially away from said housing, through said inflation region, and into said central region;

a polychromatic light source secured at a second axial end of said elongated cylindrical body opposite said first axial end and disposed within said central region such that it is at or near the circumferential center of the balloon; and electrical interconnections connecting said polychromatic light source and said control circuit.

9. The illuminable balloon assembly of claim 8, further comprising a power supply disposed within said housing such that the control circuit is enabled to provide a time-modulated voltage to the light source.

10. The illuminable balloon assembly of claim 8, wherein said light source is a light emitting diode.

11. The illuminable balloon assembly of claim 8, wherein said light source is a surface mount technology light emitting diode.

12. The illuminable balloon assembly of claim 8, wherein a portion of the balloon is disposed such that it overlays said shoulder flange and said cylindrical spacer, but does not overlay said housing.

13. The illuminable balloon assembly of claim 12, wherein when the balloon is filled with helium gas, the lift provided by the helium gas is equal to or exceeds the weight of the illuminated balloon assembly.

14. The illuminable balloon assembly of claim 8, further comprising an attachment device receiving region secured to said housing, configured to allow the connection of an external attachment device thereto.

15. The illuminable balloon assembly of claim 8, disposed with a retaining sleeve comprising:

a generally conically shaped balloon support region having an opening extending the length of the elevation of said balloon support region sized and disposed for receiving said elongated cylindrical body;

a circuitry and power supply housing receiving region, having a lateral open face sized and disposed for receiving said housing;

a securing device receiving region, extending between and connecting said balloon support region and said housing receiving region, having an opening therein sized and disposed for receiving at least one of: a portion of said elongated cylindrical body, said cylindrical spacer, and said shoulder flange; and a holding mechanism receiving region connected to said housing receiving region opposite said securing device receiving region having a opening therein sized and disposed to receive an auxiliary holding device.

16. The illuminable balloon assembly of claim 12, wherein said balloon has indicia provided on the sides thereof.

17. The illuminable balloon assembly of claim 16, where said indicia may be projected onto a surface external to the balloon when the light source is illuminated.

18. The illuminable balloon assembly of claim 12, further comprising a cinching device disposed around the balloon at that portion thereof overlying said cylindrical spacer such that a secure mechanical connection is established between said balloon and said cylindrical spacer.

19. The illuminable balloon assembly of claim 18, wherein said cinching device closes into a generally circular configuration around the balloon at the that portion thereof overlying said cylindrical spacer so as to have an inside diameter which is less than the greatest diameter of said shoulder flange.

20. A method of providing an illuminated inflated balloon by introducing therein selected parts of an illumination assembly which includes a housing, a cylindrical spacer attached thereto, a shoulder flange attached to the cylindrical spacer, an elongated cylindrical body attached to the shoulder flange, and a light source attached to the elongated cylindrical body, comprising the steps of:

inflating a balloon with an inflation gas;

providing around an inflation region of said balloon a cinching device such that the cinching device partially but not completely closes off the inflation region;

pinching the inflation region such that inflation gas does not escape from said balloon;

partially releasing the pinching of the inflation region and inserting through said inflation region the light source and elongated cylindrical body of the illumination assembly such that the light source is disposed in the interior of said balloon;

positioning a portion of the inflation region of the balloon and the cinching device over the shoulder flange and cylindrical spacer of the illumination assembly; and tightening the cinching device such that the portion of the balloon inflation region overlaying the cylindrical spacer of the illumination assembly is made to be in airtight physical contact with the cylindrical spacer, thereby securing the balloon to the illumination assembly and creating a seal which prevents leakage of the inflation gas at the cylindrical spacer.

21. An apparatus for illuminating an inflatable structure from within, comprising:

a housing having formed therein a region for accepting a power supply and a region for accepting a control circuit;

a control circuit disposed in said region for accepting a control circuit, said control circuit including circuitry for providing a time-modulated voltage to a light source electrically connected thereto;

a cylindrical spacer having an external diameter, secured at a first axial end thereof to said housing, configured to receive a portion of an inflatable structure and provide a surface against which that portion of the inflatable structure may be secured;

a shoulder flange having a region whose diameter is greater than the external diameter of said cylindrical spacer, secured to said cylindrical housing at a second axial end opposite said first axial end, configured to permit the placement of a portion of an inflatable structure thereover, but to resist removal of that portion of the inflatable structure;

an elongated cylindrical body secured at a first axial end thereof to said shoulder flange and extending axially away from said housing;

a polychromatic light source secured at a second axial end of said elongated cylindrical body opposite said first axial end; and electrical interconnections connecting said polychromatic light source and said control circuit;

a generally dome-shaped casing forming a cap at the second axial end of the elongated cylindrical body within which said light source is disposed; and an attachment device receiving region secured to said housing, configured to allow the connection of an external attachment device thereto, wherein said light source is a light emitting diode, wherein said light source is a surface mount technology light emitting diode, wherein said light source is disposed proximate the second axial end of said elongated cylindrical body but within the interior of said elongated cylindrical body, and wherein said elongated cylindrical body is configured to be inelastically deformed without breaking.

22. An illuminable balloon assembly of the type for receiving a balloon having a central region and an inflation region, comprising:

a housing having formed therein a region for accepting a power supply and a region for accepting a control circuit;

a control circuit disposed in said region for accepting a control circuit, said control circuit including circuitry for providing a time-modulated voltage to a light source electrically connected thereto; a cylindrical spacer having an external diameter, secured at a first axial end thereof to said housing, receiving a portion of the inflation region thereover and providing a surface against which that portion of the inflation region is secured;

a shoulder flange having a region whose diameter is greater than the external diameter of said cylindrical spacer, secured to said cylindrical housing at a second axial end opposite said first axial end, over which a portion of the inflation region extends, which resists removal of that portion of the inflation region;

an elongated cylindrical body secured at a first axial end thereof to said shoulder flange and extending axially away from said housing, through said inflation region, and into said central region;

a polychromatic light source secured at a second axial end of said elongated cylindrical body opposite said first axial end and disposed within said central region such that it is at or near the circumferential center of the balloon;

electrical interconnections connecting said polychromatic light source and said control circuit;

a power supply disposed within said housing such that the control circuit is enabled to provide a time-modulated voltage to the light source;

an attachment device receiving region secured to said housing, configured to allow the connection of an external attachment device thereto; and a cinching device disposed around the balloon at that portion thereof overlying said cylindrical spacer such that a secure mechanical connection is established between said balloon and said cylindrical spacer, wherein said light source is a light emitting diode, wherein said light source is a surface mount technology light emitting diode, wherein a portion of the balloon is disposed such that it overlays said shoulder flange and said cylindrical spacer, but does not overlay said housing, wherein, when the balloon is filled with helium gas, the lift provided by the helium gas is equal to or exceeds the weight of the illuminated balloon assembly, wherein the assembly is disposed with a retaining sleeve comprising: a generally conically shaped balloon support region having an opening extending the length of the elevation of said balloon support region sized and disposed for receiving said elongated cylindrical body; a circuitry and power supply housing receiving region, having a lateral open face sized and disposed for receiving said housing; a securing device receiving region, extending between and connecting said balloon support region and said housing receiving region, having an opening therein sized and disposed for receiving at least one of: a portion of said elongated cylindrical body, said cylindrical spacer, and said shoulder flange; and a holding mechanism receiving region connected to said housing receiving region opposite said securing device receiving region having a opening therein sized and disposed to receive an auxiliary holding device, wherein said balloon has indicia provided on the sides thereof, wherein said indicia may be projected onto a surface external to the balloon when the light source is illuminated, and wherein said cinching device closes into a generally circular configuration around the balloon at the that portion thereof overlying said cylindrical spacer so as to have an inside diameter which is less than the greatest diameter of said shoulder flange.

* * * * *